US009938203B2

(12) United States Patent
Shaw et al.

(10) Patent No.: US 9,938,203 B2
(45) Date of Patent: Apr. 10, 2018

(54) PYROTECHNIC COMPOSITIONS COMPRISING NANOSTRUCTURED CRYSTALLINE BORON PHOSPHIDE AND OXIDIZER

(71) Applicant: The United States of America as Represented by the Secretary of the Army, Washington, DC (US)

(72) Inventors: Anthony P. Shaw, Madison, NJ (US); Jason Brusnahan, Semaphore Park (AU); Jay C. Poret, Sparta, NJ (US); Lauren A. Morris, Midland Park, NJ (US); Christopher D. Haines, Union, NJ (US); Zhaohua Luan, Roxbury, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/429,561

(22) Filed: Feb. 10, 2017

(65) Prior Publication Data

US 2017/0204021 A1 Jul. 20, 2017

Related U.S. Application Data

(63) Continuation-in-part of application No. 15/000,593, filed on Jan. 19, 2016, now Pat. No. 9,790,093.

(60) Provisional application No. 62/293,929, filed on Feb. 11, 2016.

(51) Int. Cl.

| | |
|---|---|
| ***C06B 31/28*** | (2006.01) |
| ***C06B 39/06*** | (2006.01) |
| ***C06B 45/00*** | (2006.01) |
| *C06B 31/00* | (2006.01) |
| *D03D 23/00* | (2006.01) |
| *D03D 43/00* | (2006.01) |

(52) U.S. Cl.
CPC ..... *C06B 39/06* (2013.01); *C06B 45/00* (2013.01)

(58) Field of Classification Search
USPC ..... 149/46, 45, 109.2, 109.4
See application file for complete search history.

(56) References Cited

U.S. PATENT DOCUMENTS

| | | | | |
|---|---|---|---|---|
| 3,395,986 A | | 8/1968 | Gruber | |
| 3,944,448 A | * | 3/1976 | Marlowe | C06B 23/001 149/108.2 |
| 2005/0034447 A1 | * | 2/2005 | Joshi | B64G 1/22 60/253 |

FOREIGN PATENT DOCUMENTS

WO WO 2015/097244 A1 7/2015

OTHER PUBLICATIONS

Mukhanov V.A., et al., Self-Propagating High-Temperature Synthesis of Boron Phosphide, Journal of Superhard Materials, 2013, 415-417, vol. 35, Aillerton Press, Inc., Sverkhtverdye Materialy.

(Continued)

*Primary Examiner* — James E McDonough
(74) *Attorney, Agent, or Firm* — Lisa H. Wang

(57) ABSTRACT

A novel pyrotechnic composition comprising nanostructured crystalline boron phosphide and oxidizer such as potassium nitrate wherein the crystalline boron phosphide is synthesized by a self-propagating high-temperature reaction. The nanostructured crystalline boron phosphide and oxidizer pyrotechnic composition unexpectedly emits smoke and green flame upon ignition.

15 Claims, 7 Drawing Sheets

(56) References Cited

OTHER PUBLICATIONS

Solozhenko, Vladimir, et al., Boron Phosphide Under Pressure: In Situ Study by Raman Scattering and X-Ray Diffraction, Journal of Applied Physics, 2014, pp. 033501-1-033501-5, vol. 116, AIP Publishing LLC.

Shaw, Anthony et al., Versatile Boron Carbide-Based Visual Obscurant Compositions for Smoke Munitions, ACS Sustainable Chemistry Engineering, 2015, pp. 1248-1254, vol. 3, American Chemical Society.

Shaw, Anthony et al., Demonstration of the B4C/NaIO4/PTFE Delay in the U.S. Army Hand-Held Signal, ACS Sustainable Chemistry, 2015, pp. 1558-1563, vol. 3, American Chemical Society.

Sabatini, Jesse et al., Use of Crystalline Boron as a Burn Rate Retardant toward the Development of Green-Colored Handheld Signal Formulations, Journal of Energetic Materials, 2011, pp. 360-368, vol. 29, Taylor and Francis.

Shaw, Anthony et al., Metal-Element Compounds of Titanium, Zirconium, and Hafnium as Pyrotechnic Fuels, Proceedings of the 41st International Pyrotechnics Society Seminar, Toulouse, France, May 4-7, 2015.

Shaw, Anthony et al., Thermodynamic Modeling of Pyrotechnic Smoke Compositions, ACS Sustainable Chem. Eng. 2016, 4, 2309-2315.

* cited by examiner

PYROTECHNIC COMPOSITIONS COMPRISING NANOSTRUCTURED CRYSTALLINE BORON PHOSPHIDE AND OXIDIZER

RELATED APPLICATIONS

This continuation-in-part application claims the benefit of priority of U.S. provisional application, Ser. No. 62/293,929, filed Feb. 11, 2016, and pending application Ser. No. 15/000,593, filed Jan. 19, 2016, the contents of which are incorporated herein in its entirety.

RIGHTS OF THE GOVERNMENT

The inventions described herein may be manufactured and used by or for the United States Government for government purposes without payment of any royalties.

FIELD OF INVENTION

This present invention relates generally to pyrotechnic compositions and more specifically to pyrotechnic light-emitting and smoke-producing compositions containing nanostructured crystalline boron phosphide prepared by a high temperature synthesis reaction and an oxidizer such as potassium nitrate.

BACKGROUND OF THE INVENTION

Pyrotechnic compositions containing elemental boron or elemental phosphorus are found in critical components of ammunition and munitions. For example, amorphous elemental boron, combined with strong oxidizers such as potassium nitrate and other additives or binders has been used as a pyrotechnic igniter. Pellets composed of amorphous elemental boron, potassium nitrate, and nitrocellulose are widely used in the ignition train of medium-caliber ammunition because the rather large amount of propellant within the case cannot be ignited evenly and effectively by a primer alone. Other amorphous elemental boron-containing pyrotechnics are known in the art to produce an intense green light upon combustion, which is of use for signaling purposes on the battlefield. In addition, for many years, the U.S. Navy has used a composition containing amorphous elemental boron and barium chromate to provide precise time delays in the functioning sequences of aircraft ejection seats.

In all of these applications, the presence of elemental boron is thought to be critical. Amorphous elemental boron is known in the art as a potent pyrotechnic fuel, typically producing high reaction temperatures and both gaseous and condensed phase products. The particular physical and chemical nature of these products at the temperature they are produced, along with generally rapid combustion rates, is critical to producing the desired effect in the applications described above. For example, the green light often produced by boron-containing pyrotechnics is known to be caused by the presence of transient $BO_2$ radicals in the flame. Other chemicals used to produce green light in pyrotechnics contain copper or barium which have undesirable environmental and toxicological properties.

Despite the widespread utility of amorphous elemental boron in pyrotechnics, this material also has several undesirable characteristics. Among the common pyrotechnic fuels, amorphous boron is one of the most expensive. The method typically used to produce it does not yield a pure material. As a fine powder usually desired for use in pyrotechnics, amorphous boron is not chemically inert at ambient temperatures. It readily oxidizes in moist air. As a result, compositions containing it are notorious for their poor aging characteristics. It is highly preferable for pyrotechnic fuels to be chemically inert at ambient temperatures, and in the presence of moisture. Compositions containing such chemically inert fuels are more likely to remain unchanged over time in storage, thus ensuring a long operable shelf life for the munitions they reside within.

Crystalline elemental boron is known to be quite chemically inert at ambient temperatures, but it is even more expensive than amorphous elemental boron and is not thought to be a practical pyrotechnic fuel. Sabatini, Poret, and Broad noted in Crystalline Boron as a Burn Rate Retardant Toward the Development of Green-Colored Handheld Signal Formulations, Journal of Energetic Materials, 2011, 29, 360-368, that a pyrotechnic composition containing crystalline elemental boron as the only boron-containing fuel could not be ignited, whereas analogues containing amorphous boron were readily ignited.

The use of elemental phosphorus in munitions also has drawbacks. Phosphorus is used to produce thick white smoke for signaling, marking targets, and screening troop movements. Although white phosphorus (WP) offers the greatest visible obscuration performance of any known substance, it presents serious hazards and logistical complications. WP is typically dispersed aerially by bursting mortar or artillery projectiles. Combustion upon contact with the atmosphere produces phosphorus oxides that are extremely hygroscopic. These oxides rapidly absorb atmospheric moisture resulting in the formation of a large and highly effective smoke screen. However, scattered WP particles do not combust instantaneously and therefore can cause collateral damage in combat as well as the contamination of domestic training ranges. Due to the pyrophoric nature of WP, smoke munitions containing this substance must be stored near a source of water so that they may be submerged if damaged.

To address some of the hazards associated with WP, smoke compositions containing red phosphorus (RP) were developed, although this approach has introduced other logistical issues. RP-based smoke compositions slowly degrade in the presence of air and trace moisture, producing acids that corrode munition components and phosphine gas that is highly toxic and flammable. The use of microencapsulated and stabilized RP slows the aging process but does not completely inhibit it. Additionally, RP-based smoke compositions are generally very sensitive to unintended ignition by impact, friction, and electrostatic discharge. Notably, the most problematic characteristics of phosphorus-based smoke munitions are caused by the white or red phosphorus itself, and not the resulting phosphoric acid aerosol produced upon combustion.

Like boron, phosphorus can exist in more crystalline and chemically inert forms. The violet and black allotropes of phosphorus are far less reactive than white or red phosphorus at ambient temperatures. However, practical methods that could be used to mass-produce these phosphorus allotropes have not been reported. And again, as with boron, it is not known whether these unreactive crystalline allotropes could serve as pyrotechnic fuels.

Smoke compositions containing hexachloroethane (HC), zinc oxide, and aluminum were developed in the 1940s. The zinc chloride formed and aerosolized upon combustion is deliquescent making the resulting cloud exceptionally large, dense, and effective for screening. Unlike most phosphorus-based smoke compositions, which burn in direct contact with the atmosphere, HC compositions are usually pressed into steel canisters. The smoke is released through small vent holes at one or both ends. HC smoke grenades are no longer used by the U.S. Army due to the acute toxicity of the smoke, which has caused accidental inhalation-related injuries and deaths. Despite a number of efforts to address this problem, less toxic alternatives with comparable efficacy remain elusive.

Given the problems associated with amorphous elemental boron and elemental phosphorus in pyrotechnics, a need exists for alternatives. It has been discovered that the use of nanostructured crystalline boron phosphide as a pyrotechnic fuel can provide the desirable pyrotechnic qualities of boron and phosphorus, without the problems associated with the use of the elements themselves. The inventive pyrotechnic compositions may be used to produce green light or smoke, with combustion properties that may tailored to suit specific pyrotechnic applications.

SUMMARY OF THE INVENTION

It is an object of the invention to prepare pyrotechnic compositions comprising nanostructured crystalline boron phosphide and an oxidizer wherein the nanostructured crystalline boron phosphide is prepared by a self-propagating high-temperature synthesis reaction. The reaction process comprises combining boron phosphate and magnesium metal into a homogenous mixture without the need for temperature-controlling diluents, loosely packing the mixture at a pressure of 0 to 20,000 psi, and igniting the mixture using minimum energy input to produce crystalline boron phosphide. The nanostructured crystalline boron phosphide that is produced is then combined with an oxidizer to form a pyrotechnic composition.

In one aspect of the invention, the oxidizer is selected from the group consisting of potassium nitrate, potassium chlorate, potassium perchlorate, sodium periodate, and sodium persulfate.

In another aspect of the invention, the specific surface area of the nanostructured crystalline boron phosphide is between 0.05 m2/g and 40 m2/g, and preferably between 0.5 m2/g and 20 m2/g and even more preferably between 4 m2/g and 14 m2/g.

In yet another aspect of the invention, the pyrotechnic composition produces smoke and a flame, flash or light upon ignition.

BRIEF DESCRIPTION OF THE DRAWINGS

Further features and advantages of the present invention may be understood from the drawings.

DETAILED DESCRIPTION

Figure 1:
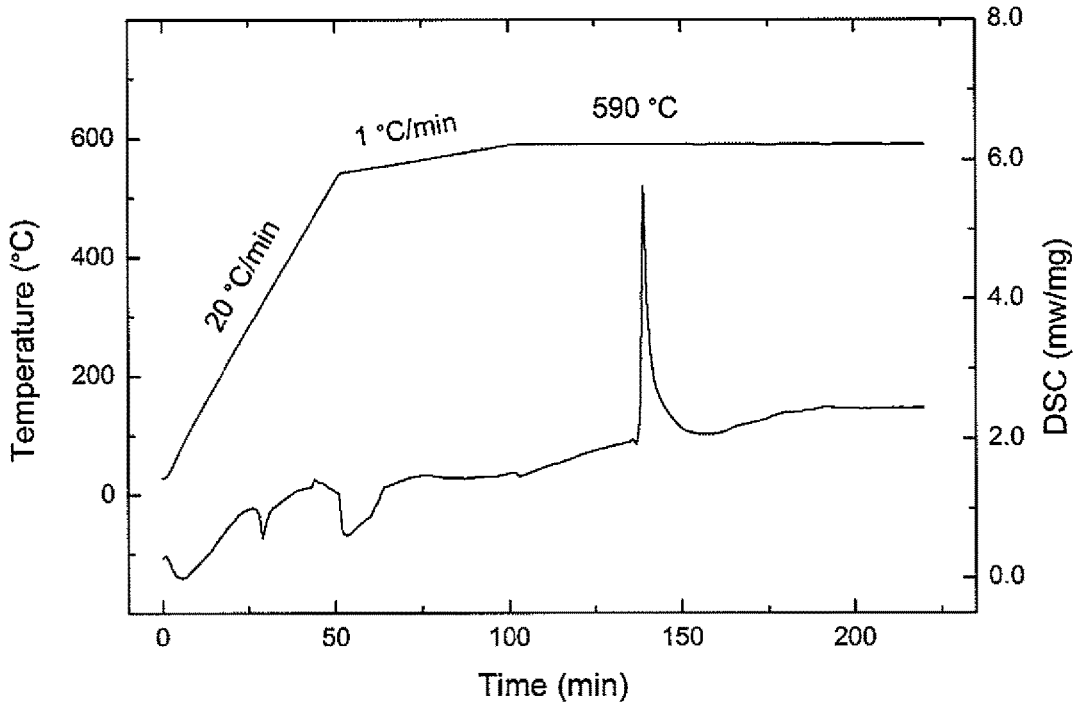
FIG. 1. Heat curve of the powder mixture for BP synthesis upon subjection to a sequence of heating treatment.

The invention disclosed herein provides for pyrotechnic compositions comprising nanostructured crystalline boron phosphide prepared by a self-propagating high-temperature synthesis (SHS) and strong oxidizers such as potassium nitrate, potassium chlorate, potassium perchlorate, sodium periodate, and sodium persulfate. These compositions produce a variety of desirable effects upon combustion that are characteristic of both boron and phosphorus. These effects include a vivid green flame or flash and the production of thick white smoke.

Boron phosphide (BP) is known to be chemically inert at ambient and moderately elevated temperatures, a property that is highly desirable in a pyrotechnic fuel, for the reasons mentioned above. BP is surprisingly resistant to hydrolysis. For example, it is not attacked by boiling concentrated hydrochloric acid. The ability of BP to resist chemical attack would impart favorable aging characteristics to BP-based pyrotechnic compositions. Unlike amorphous elemental boron, crystalline BP is resistant to oxidation. In contrast to red phosphorus, BP is not known to produce phosphine gas in the presence of air and moisture. In some respects, BP resembles boron carbide ($B_4C$). Both are remarkably inert and are only attacked under extreme conditions, by hot molten oxidizers such as potassium nitrate or sodium peroxide. In a very early report concerning the synthesis and properties of BP, Henri Moissan in Preparation and Properties of Boron Phosphides, C. R. Acad. Sci. 1891, 113, 726-729, noted that the compound incandesced and deflagrated when "projected onto a bath of molten alkali nitrate".

A common laboratory technique for the analysis of ceramic and refractory compounds including borides, silicides, carbides, and phosphides, first involves digestion of the materials in a molten oxidizer such as a nitrate or peroxide. However, this reactivity does not indicate the utility of the materials as pyrotechnic fuels. In addition to undergoing reaction, pyrotechnic fuels must do so in a way that causes self-propagation of a combustion wave through a pyrotechnic composition. Pyrotechnic compositions are typically composed of intimately mixed powdered solid components, and are not pre-heated in the aggregate before being ignited by a small, localized heat source. Therefore, Henri Moissan's observation that BP reacted upon contact with a nitrate salt that was already pre-heated and molten, does not indicate with any certainty whether BP is able to serve as a pyrotechnic fuel.

Marlowe and Tannenbaum in Thixotropic Monopropellant Containing Inorganic Phosphides or Phosphide Alloys, U.S. Pat. No. 3,944,448, Mar. 16, 1976, have described monopropellant compositions containing inorganic phosphides or phosphide alloys and liquid oxidizers such as nitric acid, nitrogen tetroxide, or hydrogen peroxide. Presumably, these compositions are able to undergo self-sustaining combustion. However, the liquid oxidizers described are quite different from typical pyrotechnic oxidizers, which are universally solids. Liquid oxidizers such as nitric acid are exceptionally reactive and are more likely to form hypergolic mixtures with fuels, that is, mixtures that undergo spontaneous combustion. In fact, it is known that the addition of just one or two drops of nitric acid to pyrotechnic compositions containing magnesium or aluminum can cause spontaneous ignition, without the application of heat. Liquid oxidizers are chemically incompatible with many common pyrotechnic ingredients (including fuels, binders, stabilizers, flow agents, and others), and are inappropriate for pyrotechnic applications. Further, the prior art disclosed by Marlowe and Tannenbaum gives no indication as to whether boron phosphide could serve as a pyrotechnic fuel in compositions containing only solid components.

Metallic phosphides, such as boron phosphide and titanium phosphide (TiP), are generally much more chemically inert than ionic phosphides. Ionic phosphides such as sodium or calcium phosphide ($Na_3P$, $Ca_3P_2$) react violently with water and are highly susceptible to degradation in the presence of moisture. This complicates the use of ionic phosphides in pyrotechnics, where resistance to reaction with air and moisture upon aging is highly desirable.

Of the metallic phosphides that are known, BP has the highest phosphorus density. BP contains 74 wt % phosphorus and has a crystalline density of 2.97 g/cm$^3$. Boron phosphide crystals actually contain more phosphorus per cubic centimeter than pure white phosphorus (2.20 g-P/cm$^3$ for BP compared to 1.82 g-P/cm$^3$ for white phosphorus). In contrast, the phosphorus density of TiP is just 1.60 g-P/cm$^3$. Other phosphorus-containing compounds, such as alpha-$P_3N_5$, contain even less phosphorus on a volumetric basis.

Surprisingly, it has been discovered that boron phosphide is a highly active pyrotechnic fuel. Compositions containing BP and potassium nitrate ($KNO_3$), potassium chlorate ($KClO_3$), potassium perchlorate ($KClO_4$), sodium periodate ($NaIO_4$), and sodium persulfate ($Na_2S_2O_8$) are easily ignited with a hot wire. These compositions undergo self-sustained combustion, and produce a variety of effects that are desirable for pyrotechnic applications. Several of the compositions produce a brilliant green flame or flash, accompanied by a thick cloud of white smoke, and thus exhibit the pyrotechnic characteristics of both boron and phosphorus.

The pyrotechnic behavior of boron phosphide, a crystalline and generally inert material, was unexpected. It is generally understood in this technical field that the combination of two elements in a compound does not necessarily yield a material with the properties of both of the elements themselves. Shaw, Sadangi, Poret, and Csernica noted in Metal-Element Compounds of Titanium, Zirconium, and Hafnium as Pyrotechnic Fuels, Proceedings of the 41$^{st}$ International Pyrotechnics Society Seminar, Toulouse, France, May 4-7, 2015 that a variety of metal-element compounds possessed widely varying pyrotechnic characteristics that could not be predicted from the known behavior of the individual elements. For example, while zirconium and silicon are both highly active pyrotechnic fuels when combined with a variety of oxidizers, stoichiometric $ZrSi_2$/$KNO_3$ could not be ignited and stoichiometric $ZrSi_2$/$Bi_2O_3$, once ignited, smoldered slowly producing an incandescent pile of slag. In these instances, the lack of pyrotechnic reactivity or subdued reactivity was uncharacteristic of the known behavior of elemental zirconium and elemental silicon in pyrotechnic compositions. In other cases, compositions containing metal-element compounds and $KNO_3$ or $Bi_2O_3$ were shown to be violently, even explosively, reactive.

The ability of a boron-containing pyrotechnic composition to emit vivid green light upon combustion is similarly difficult to predict. Shaw, Sadangi, Poret, and Csernica found that both $ZrB_2$/$KNO_3$ and $HfB_2$/$KNO_3$ compositions emit an intense green light upon combustion, presumably due to the formation of transient $BO_2$ radicals in the flames. However, $TiB_2$/$KNO_3$ produced mainly white light, with only a subtle hint of green. The identity of the oxidizer also plays an important role. Mixtures of $TiB_2$, $ZrB_2$, or $HfB_2$ with $Bi_2O_3$ all burned with an orange or orange-yellow flame. Further, the production of $BO_2$ radicals, which can cause green light to be produced, cannot be predicted by computational methods reliably. This is because the computational methods generally predict combustion products with an accuracy of about plus or minus 3 weight-%, depending on several factors. A perceptible green color can be produced by as little as about 1 weight-% $BO_2$ in a flame. Shaw, Brusnahan, Poret, and Morris in Thermodynamic Modeling of Pyrotechnic Smoke Compositions, ACS Sustainable Chem. Eng. 2016, 4, 2309-2315 calculated the theoretical combustion products of BP/$KNO_3$ mixtures using known thermochemical parameters and did not predict $BO_2$ as a combustion product. Thus, there was no indication that BP/$KNO_3$ mixtures could emit green light upon combustion. Further, there was no indication that BP/$KNO_3$ mixtures could undergo self-sustaining combustion, as this property depends on kinetic factors that cannot be predicted from thermochemical parameters.

The boron phosphide (BP) produced by the method described herein and in U.S. application Ser. No. 15/000,593, the disclosure of which is incorporated by reference in its entirety, was found to be crystalline by X-ray diffraction, with a face-centered cubic unit cell. Scanning electron microscopy revealed that the as-synthesized BP product consists of nanoparticles and microscale particles possessing a nanostructured porous morphology. The Brunauer, Emmet, and Teller (BET) specific surface area (SSA) of the BP sample was determined to be 8.101 m$^2$/g. If the sample were considered to be composed of spherical particles, this would correspond to an average particle diameter of 255 nm. Laser diffraction was used to measure the volume-based particle size distribution of the sample. The mean particle diameter was found by this method to be 29.88 micron. The 10th, 50th, and 90th percentiles of the distribution were 8.30 micron, 22.24 micron, and 55.90 micron. These values are influenced by particle agglomeration and the laser diffraction method does not reveal the nanostructured nature of the material. Generally, a material is considered nanostructured if it possesses features in at least one dimension at the nanoscale, in a range of about 1 nm to about 100 nm. Such materials often, but do not always, possess a high surface area with respect to their bulk volume and mass. Importantly, the diameter of a nanostructured particle may or may not be within the nanoscale. Particles with diameters within or beyond the microscale can be nanostructured, provided they possess nanoscale features. The microscale is considered to include a range of lengths from about 1 micron to about 100 micron. Generally, measurements of specific surface area (SSA) are better correlated with the degree of nanostructure, whereas laser diffraction is a better indicator of the diameter of the larger particles.

The specific surface area of the nanostructured crystalline boron phosphide used herein is between 0.05 m$^2$/g and 40 m$^2$/g, and preferably between 0.5 m$^2$/g and 20 m$^2$/g and even more preferably between 4 m$^2$/g and 14 m$^2$/g.

Synthesis of the crystalline BP is performed by a pyrotechnic method in which self-propagating high-temperature synthesis reaction between boron phosphate and magnesium metal particles is initiated with a limited amount of energy input and sustained by its own heat output of about 1050 cal/g (4393 J/g). It has been discovered that by loosely packing the reactants in a column, other factors affecting the SHS synthesis of BP such as heat input and use of diluents to control temperature can be minimized to produce BP at high yields. The energy output from the reaction is sufficient enough to sustain a propagating combustion wave from one end of the mix column to the other despite the loose packing of the reactants.

To constitute a truly self-sustaining reaction as disclosed herein a mixture of fine boron phosphate and magnesium metal particles is loosely packed into a column with desirable cross-sectional characteristics. Pressure may be applied onto the column. Such applied pressure should not exceed 20,000 psi (most preferably, less than 10,000 psi) in order to produce a mixture that has low thermal conductivity. The column can be easily ignited remotely by any known arts of pyrotechnic means with a minimal energy input. As a thermal-dynamic process, the burning temperature of this SHS synthesis reaction is largely a function of the pressure with which the mix is pressed and thus the cross-section characteristics of the column prepared using that pressure, i.e. material packing density, which eventually determines the purity and yield of the resulting BP. For a loosely packed column of the mixture for BP synthesis, there is no need to use a diluting agent such as sodium chloride for temperature control purposes, a clear advantage over the current art.

By definition, the SHS synthesis is a self-sustaining reaction initiated by point-heating of a small part of the materials, i.e. a minimum amount of energy input for initiation purposes only. Once started, an exothermic combustion wave sustains itself and sweeps progressively through the remaining body of the materials. The transfer of heat among reactant particles in an exothermic reaction is understandably a complex thermodynamic process with the simultaneous occurrence of possibly all heat transfer modes, i.e. conduction, convection, and radiation, although the last mode is usually less pronounced than the other two. Many SHS synthesis reactions involve solid reactants and products, although these materials may be present transiently as liquids due to the high temperatures involved. Gas production is usually minimal, and the primary mode of heat transfer within the reactant mixture is conduction. In this context, conduction is the transfer of heat between reactant particles (or liquid zones) and is largely a function of the thermal conductivity of the materials, the packing density of the mixture, and the local temperature gradient. Convection could also occur as a minor heat transfer mode in porous mixtures.

SHS synthesis of pellets as reported by Mukhanov was prepared by pressing the reactant powders at high pressures. These pellets are dense, relatively non-porous, and highly thermally conductive, especially when such pellets contain thermally conductive materials such as magnesium. These dense and thermally conductive pellets are difficult to ignite with a point-source of heat. Heat is rapidly transmitted by conduction throughout the body of such pellets which can delay the localized temperature increase required to achieve ignition. The amount of energy required to achieve reliable ignition can cause significant pre-heating of the entire reactant mixture. Once ignition finally occurs, heat produced by the reaction is also rapidly conducted throughout the mixture. Such rapid and efficient conductive heat transfer, the heat originating from both the ignition source and the synthesis reaction, can lead to high reaction temperatures and the production of reaction products that are not desired, including impurities. In fact, the high density and high thermal conductivity of the SHS synthesis pellets described by Mukhanov may have resulted in increased reaction temperatures that ultimately caused the formation of the $B_{12}P_2$ impurity, thereby necessitating the use of inert diluents such as sodium chloride to prevent the formation of that impurity. However, as previously described, the use of the sodium chloride diluent can make the synthesis pellets difficult to ignite, and reduces the yield of BP with respect to the total mass of the starting materials.

A stoichiometric mixture for BP synthesis contains approximately 50% magnesium and 50% boron phosphate by mass. The primary mode of heat transfer during the reaction, that sustains the self-propagating high-temperature synthesis, is conduction. A high-yield reaction for the synthesis of BP may be achieved by packing the magnesium and boron phosphate reactants loosely. Loose packing lowers the thermal conductivity of the mixture which reduces the rapidity and efficiency of heat transfer. In turn, this results in lower reaction temperatures and minimizes the formation of undesirable impurities such as $B_{12}P_2$. Notably, the addition of an inert diluent is not required, and the heat generated by the reaction is sufficient to sustain a self-propagating combustion wave, despite the reduced thermal conductivity of the mixture. Additionally, the lower thermal conductivity of the loosely-packed mixture makes it easier to ignite—application of a point-source of heat rapidly raises a localized area of the mixture to the ignition temperature.

The improved high yield synthesis of crystalline BP as disclosed herein starts with thoroughly mixing fine boron phosphate ($BPO_4$) and magnesium metal particles, in a mass ratio of 1.0+/−0.5 but most preferably 1.0+/−0.2, and then packed, with or without added pressure into a column of any shape and length. The mixture can be packed in a self-standing pellet form or a powderous column. The column can be composed of a tubular structure made of cardboard or other combustible material which can be eventually burnt off and completely removed after the synthesis. Alternatively, the column can be composed of ceramic, steel, carbonsteel, or any material that is structurally sound and thermally stable to survive a high reaction treatment in excess of 1000° C. If pressure is applied onto the homogenous mixture, it should not exceed 20,000 psi, most preferably, less than 10,000 psi, in order to produce a porous body of the mix with low thermal conductivity. The column can be easily ignited remotely via any known arts of pyrotechnic means with a minimum amount of energy input, such as a hot wire or an electric match with or without a secondary ignition mix such as a thin coating onto one end of the mix column. The amount of initiating energy (i.e. minimum energy input) that is applied to rapidly raise a localized area of the mixture to the ignition temperature could be fixed and would not depend on the synthesis batch size. A preferred non-limiting example of a fixed minimum energy input is 2.3 calories to 11.5 calories. Alternatively, the minimum energy input may be modified according to the scale of the homogenous mixture. Under such processing conditions, the minimum energy input can be based on a calorie input per weight of the pellet. Such minimum energy input, however, should not exceed about 20% of the heat output of the homogenous mixture (i.e. 218 calories/gram) preferably about 0.025% to about 20% of the heat output of the homogenous mixture.

The invented process for crystalline BP synthesis can be easily implemented with any known art of material processing technologies for large-scale industrial production. As an example, the precursor chemicals boron phosphate and magnesium metal particles can be mixed and compacted with a twin-screw extruder and transported continuously through a tubular column into a combustion chamber where the mix is ignited only once at the start of a lot production. The product from the combustion is then continuously scrubbed mechanically into a downstream recovery vessel where the crystalline BP is separated and recovered. In such an embodiment, the energy required to start the reaction, by igniting a portion of the mixture, would be small in comparison to the total energy released by the continuous, exothermic, and self-sustaining reaction.

Non-limiting embodiments of the invention is further demonstrated in the following examples.

Example 1

Ground magnesium powder of about 200 mesh particle size was purchased from Magnesium Elektron Powders, and fine boron phosphate powder, in anhydrous form, was a sample from BassTech International. For crystalline BP synthesis, the magnesium and boron phosphate powders were mixed in a container with a mass ratio of 1/1, which is about a 4/1 molar ratio with 10% more magnesium in excess, followed by vigorous shaking and stirring by hand or a blending machine.

In an initial test, a 4.6 mg quantity of the mix was loaded into a ceramic pan in an apparatus for thermal analysis, heated in argon first at a rate of 20° C./min to 540° C., then heated at 1° C./min to 590° C., and then maintained at the final temperature for extended period of time. As can be seen in FIG. 1, a dramatic exothermic event, other than an expected slow thermal process, occurs in the isotherm section of the measurement. The temperature at which the reaction took place is noticeably lower than the melting point of the bulk magnesium metal (649° C.) but comparable with a reduced melting point expected for the fine magnesium powders. The result indicates that the SHS reaction between boron phosphate and magnesium is possibly triggered by the presence of hot magnesium melt. The heat capacity of magnesium metal at 25° C. is about 1.0 J/(g·K) whereas at 590° C. it is 1.3 J/(g·K). If it is assumed that the synthesis mixture has a heat capacity of about 1.3 J/(g·K) or less, it would require at most 735 J/g to heat the mixture from room temperature to 590° C. It would require an additional 175 J/g to melt all of the magnesium in the mixture (the enthalpy of fusion of magnesium is about 350 J/g). Thus, it would require, at most, about 910 J/g (218 cal/g) to ignite the mixture. It is possible to cause ignition using even less energy in configurations where only a portion of the mixture is heated, without significantly preheating the bulk of the mixture, as described in subsequent examples. Even so, the estimated maximum ignition energy that could be required, about 218 cal/g (910 J/g), is small in comparison to the measured heat output of the self-sustaining reaction, which is 1050 cal/g (4393 J/g). The estimated maximum ignition energy in this example, taken as a percentage with respect to the heat output of the reaction, is about 20.7%.

A determination that the minimum energy input should not exceed about 20% or 218 calories/gram is based on the discovery that the heat output from the exothermic reaction between boron phosphate and magnesium metal particles was measured at 1050 cal/g (4393 J/g). This is comparably higher than that of many pyrotechnic mixes, such as commercially available black powder.

A replicate test with the same heating program but a much larger sample size of around 50 g was conducted in a muffle furnace. The exothermic reaction apparently took place once it reached a temperature of close to 590° C., and proceeded rapidly until completion. A portion of the residue was collected for X-ray diffraction analysis, which indicated the presence of crystalline BP and other products. The experiment confirmed again that the auto-ignition temperature of the reactant mixture is approximately 590° C.

Example 2

A mixture of fine magnesium and boron phosphate powders was prepared as described in Example 1, A sample of around 1 g was then transferred into a steel cup and mounted into a steel container associated with a Parr 1266 Bomb calorimeter. The container was sealed and pressurized with argon to 450 psi, and the reaction was initiated with an electrically heated fuse wire of 10 cm length. The fuse wire had a correction factor of 2.3 cal/cm (9.6 J/cm), which accounts for the heat of combustion of the fuse wire and, approximately, for the very small amount of electrical energy supplied to heat it. Generally, the electrical energy supplied is small in comparison to the heat of combustion of the fuse wire, allowing one correction factor to be used regardless of the exact amount of electrical energy applied. Upon initiation, a dramatic exothermic event was recorded with a heat output of about an average of 1050 cal/g (4393 J/g). The test was repeated at least 3 times, and the results were consistent as shown in Table 1.

TABLE 1

Heat output of boron phosphate and magnesium powder mix for BP synthesis in comparison with known pyrotechnic formulations.

| Materials | Test Run | Heat output (cal/g) | Average (cal/g) |
|---|---|---|---|
| Mix for BP synthesis | 1 | 1032 | 1050 |
| | 2 | 1045 | |
| | 3 | 1072 | |
| Black powder | — | — | 718 |

It was found that less than 5 cm of the electrically heated fuse wire was consumed, of which about 1 cm was in direct contact with the mixture. Complete combustion of 5 cm of the wire would have produced about 11.5 cal (48.1 J) of energy, a small amount in comparison to that produced by the exothermic reaction. Although, in these particular experiments, which were conducted under argon pressure, combustion of the wire could only occur with the participation of oxygen produced transiently in the reaction, making complete combustion highly improbable. Combustion of the wire, if it occurred at all, more probably involved only the 1 cm portion in direct contact with the mixture, corresponding to an energy of about 2.3 cal (9.6 J). The other 4 cm having been vaporized by the heat of the reaction. Therefore, the ignition energy in this configuration can be, at the most, about 11.5 cal, and more probably about 2.3 cal or less. In comparison, this corresponds to about 1% or less with respect to the heat output of the reaction, or to about 5% or less with respect to the energy required to heat the entire sample to the ignition temperature and melt all of the magnesium. This indicates that the threshold of the energy input for the initiation of the mix in powder form for BP synthesis is quite low and that the consistency of the heat output in a number of replicate experiments suggests the reaction is self-sustainable to its completion once initiated.

The products of the reaction were recovered with a mass yield close to 100%, and X-ray diffraction analysis indicated the presence of crystalline BP and other products.

Example 3

A mixture of fine magnesium and boron phosphate powders was prepared as described in Example 1. A total of 4 g of the mix was pressed in 2 increments into a cardboard tube of 10 mm in inner diameter and 50 mm in length. Tubes were prepared in this way by pressing the mix with pressures ranging from 8,600 to 30,000 psi. A minimum of 3 tubes containing the consolidated mixture were produced at each pressure and one end of each pellet was coated with a thin layer of about 50 mg of A-1A ignition composition, a standard igniter composition with a heat output of around 450 cal/g (1883 J/g), which is equivalent to an energy input of about 22.5 cal (94.1 J) once ignited, in this configuration. The A-1A igniter composition, as described in the military specification MIL-P-22264A, contains zirconium, red iron oxide, and diatomaceous earth in a 65/25/10 weight ratio. In comparison, the thermal energy input of about 22.5 cal for ignition is remarkably small, which amounted to only about 0.54% of the heat output of the reaction, or about 2.59% with respect to the energy required to heat the entire pellet to the ignition temperature and melt all of the magnesium.

Each pellet with an A-1A coating was ignited remotely with an electric match not in direct contact with the pellet, and the test record regarding ignitibility and burning characteristics of those pellets is summarized in Table 2. The pellets were observed and the reaction was analyzed with high-speed video to determine the complete burning of the pellet.

TABLE 2

Ignition and burning characteristics of the pellets of the mix for BP synthesis prepared at varying pressures and ignited via a pyrotechnic pathway.

| Materials | Press pressure (psi) | Test Run | Ignition | Completion |
|---|---|---|---|---|
| Mix for BP synthesis | 8600 | 1 | Yes | Yes |
| | | 2 | Yes | Yes |
| | | 3 | Yes | Yes |
| | 17200 | 1 | Yes | No |
| | | 2 | Yes | No |
| | 22631 | 1 | Yes | No |
| | 28063 | 1 | Yes | No |
| | | 2 | No | No |

As can be seen from Table 2, the pellets pressed with higher pressures either failed to be ignited or resulted in incomplete burning. This seems to be due to the higher thermal conductivity of a metallic magnesium column produced at higher pressure, and, therefore, the rapid dispersion of heat throughout the pellet resulting in extinguishment of the exothermic combustion wave.

The products from the pellets prepared with the lowest pressure (8,600 psi) were recovered and characterized by X-ray diffraction analysis as containing very fine crystalline BP particles as shown below.

Example 4

A large batch of the mix for crystalline BP synthesis was prepared as described in Example 1. Large pellets of 87 g were made by pressing the mix with a pressure of about 8,600 psi, in at least 3 increments, into cardboard tubes of 32 mm in inner diameter and 85 mm in length. The pellets were coated with a thin layer of A-1A igniter composition (at least about 50 mg) and ignited remotely with an electric match. The ignition energy was about 0.26 calories per gram of synthesis mixture, as calculated considering 50 mg of igniter composition. In comparison, this thermal energy input for ignition is significantly small, corresponding to only about 0.025% of the heat output from the reaction, or to about 0.12% with respect to the energy required to heat the entire pellet to the ignition temperature and melt all of the magnesium. A violent, but steady and complete burn was observed, and the ashes produced were collected for product analysis and purification. Typically, the ash sample was digested in a sufficient amount of boiling hydrochloric acid solution for at least 6 hours; the solid was then recovered and further washed with distilled water to remove impurities. After being dried at 120° C., a dark-brownish powder was obtained.

Figure 2:
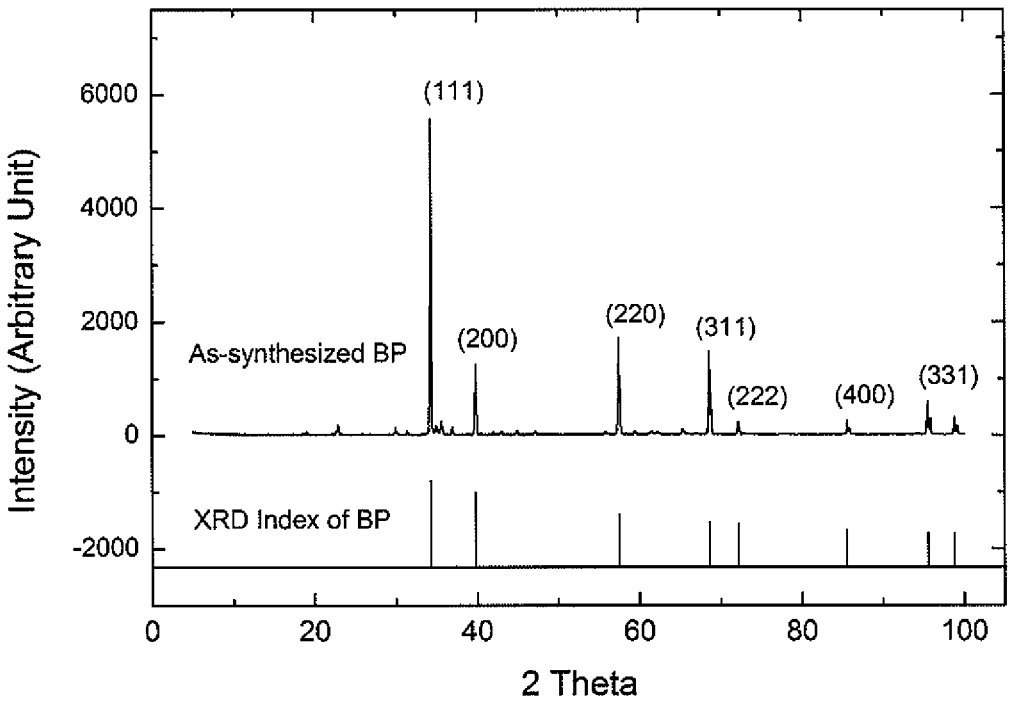
FIG. 2. X-ray diffraction micrographs of the final solid product from the BP synthesis.
Figure 3:
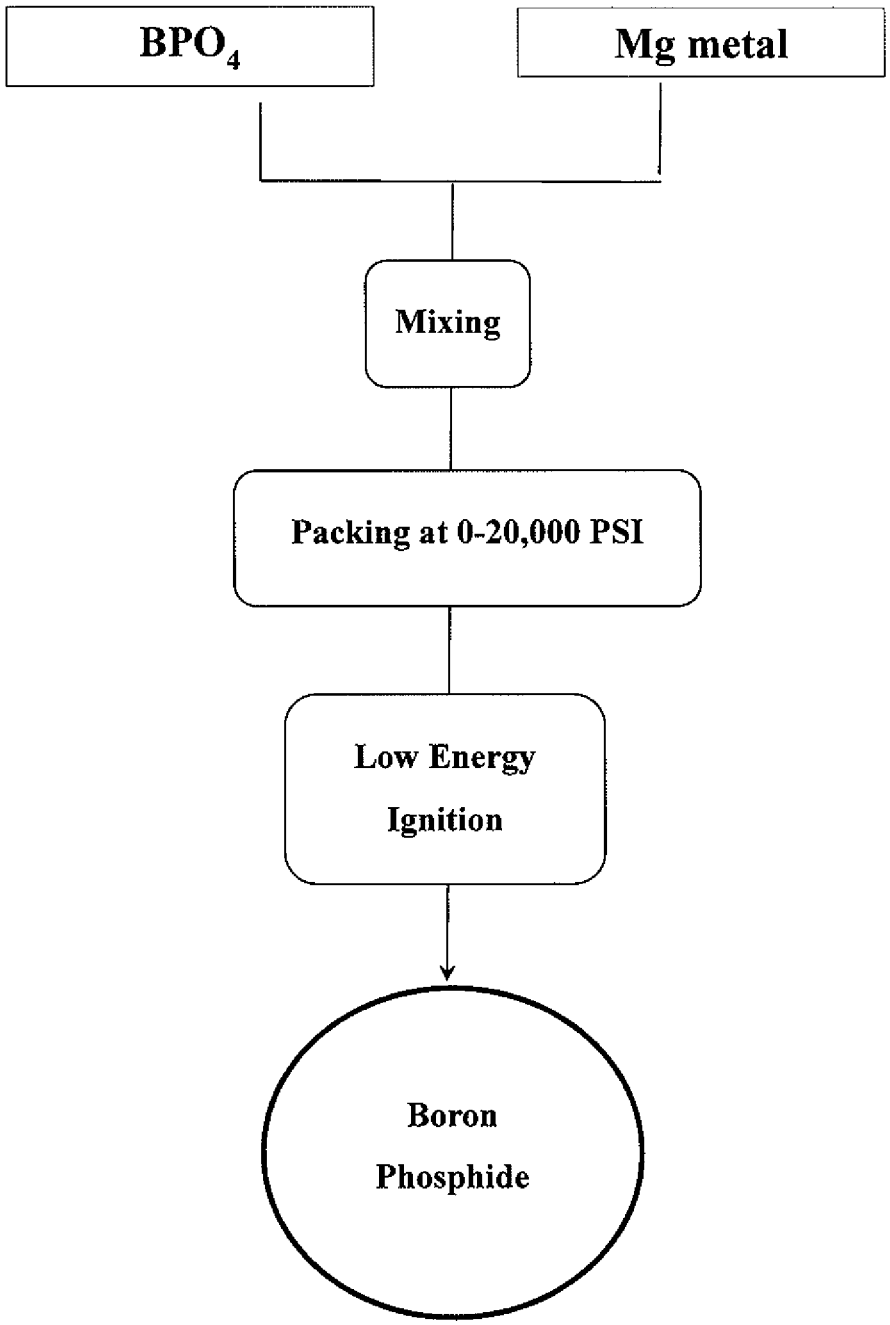
FIG. 3. is a flow chart of the process for synthesizing boron phosphide in high yield as disclosed herein.

As shown in FIG. 2, the X-ray diffraction pattern of the solid products show strong lines which can be well-indexed to a crystalline BP phase with face centered cubic cell units, indicating a successful BP synthesis. A further scanning electron microscope (SEM) image, reveals that the as-synthesized BP product is present either as nanoparticles or in a porous morphology with finer nanostructures.

Example 5

Figure 4:
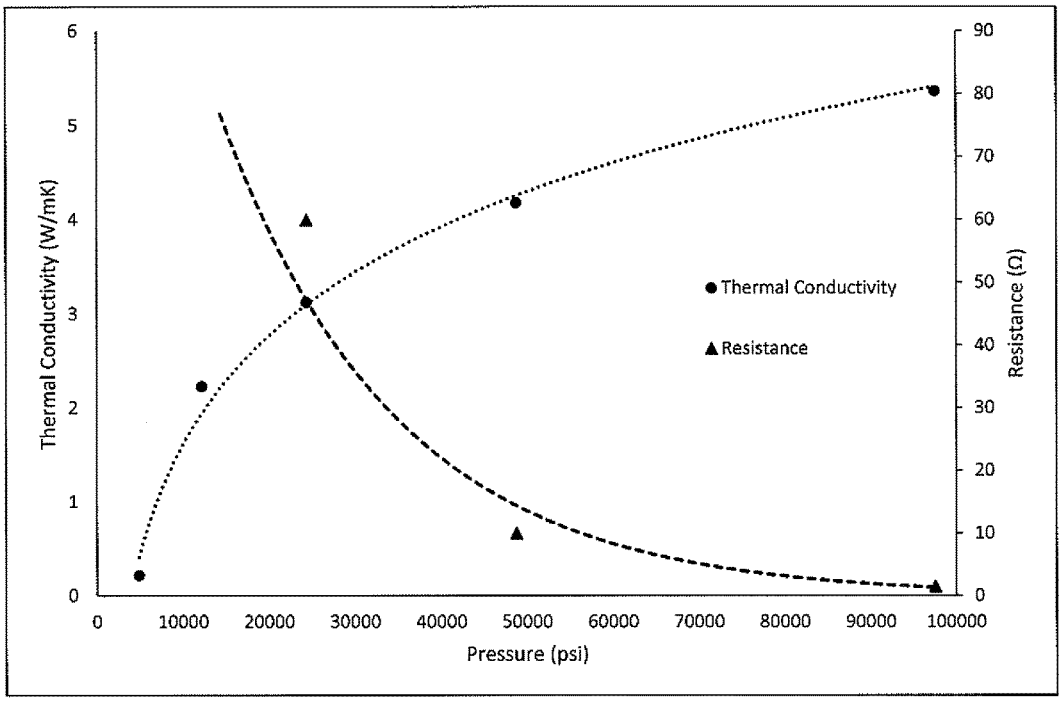
FIG. 4. is a plot illustrating the dependence of thermal conductivity and electric resistance of the pellets of the precursor mix for the BP synthesis on the pressure used to make the pellets.

A mixture of fine magnesium and boron phosphate powders was prepared as described in Example 1. A set of the mix weighted 1 g was pressed with a die of 13 mm in inner diameter at increasing pressure ranging from 4,600 to 100,000 psi. As shown in Table 3 and the corresponding plot illustrated in FIG. 4, a higher pressure led to a higher packing density of a pellet with reduced thickness, but the increase in both thermal and electric conductivity are extraordinary. The results are in full agreement with SHS synthesis tests, shown in Table 2, that the reaction occurs and proceeds to completion only for those pellets pressed at lower pressure and therefore having lower thermal and electric conductivity.

TABLE 3

Physical dimension, thermal conductivity, and electric resistance of the pellets of the precursor mix for BP synthesis which were pressed with increasing pressure*.

| Pressure (psi) | Thickness (mm) | Appearance | Thermal Conductivity** (W/mK) | Electric Resistance*** (Ω) |
|---|---|---|---|---|
| 4876 | 5.3 | Dusty grey | 0.219 | ∞ |
| 12190 | 5.3 | Dusty grey | 2.232 | ∞ |
| 24380 | 4.7 | Metallic silver | 3.124 | 60.0 |
| 48761 | 4.3 | Metallic silver | 4.180 | 10.0 |
| 97521 | 4.0 | Metallic silver | 5.365 | 1.5 |

*All pellets were made from 1.0 g precursor mix with a die of 13 mm in diameter.

**The thermal conductivity through the axis of the pellets was determined with a C-Therm TCi thermal conductivity analyzer. The data set only shows the trend of change but not necessarily an accurate measurement due to lack of a common standard for pellets with vastly different properties.

***The electric resistance between the surface centers of the pellets was measured with a KleinTools MM1000 multimeter.

Pyrotechnic compositions containing nanostructured crystalline BP prepared by SHS as previously described were prepared by mixing the BP with a strong oxidizer such as potassium nitrate ($KNO_3$), potassium chlorate ($KClO_3$), potassium perchlorate ($KClO_4$), sodium periodate ($NaIO_4$), and sodium persulfate ($Na_2S_2O_8$). The resultant compositions were tested by igniting them with a hot wire.

Example 6

Pyrotechnic compositions containing: 1) boron phosphide alone; 2) boron phosphide with powdered or granular inorganic oxidizers; and 3) boron carbide and potassium nitrate were prepared. The compositions were tested by placing a small sample of about 0.50 grams on a ceramic tile within an aluminum pan. An electrically heated nickel-chromium wire served as an ignition source. Upon ignition, the mixtures underwent self-sustaining combustion and exhibited a variety of desirable pyrotechnic effects as described further below.

Boron phosphide alone. The control experiment involved a sample of boron phosphide (with no added oxidizer) that was tested as described above. The boron phosphide sample alone did not ignite, and did not sustain combustion. Instead, a thin stream of smoke slowly formed as the sample was heated with the hot wire. The sample was largely unchanged, and underwent decomposition only where it was heated by the wire.

Boron carbide and potassium nitrate powder. The comparative experiment involved a mixture of fine boron carbide powder and fine potassium nitrate powder in a 15/85 weight ratio. Despite the fact that boron carbide is known in the art to be an effective pyrotechnic fuel, the composition tested in this configuration only combusted partially, and slowly, in great contrast to the generally rapid and complete combustion events of the BP/oxidizer mixtures. This may have been because the boron carbide powder was composed of micron-sized particles and was not a nanostructured material.

Boron phosphide with oxidizers. The pyrotechnic behavior of the combustion events may be controlled by changing the identity of the oxidizer. Table 4 illustrates the reactant materials, their properties and specification.

TABLE 4

Material Properties and Specifications

| material | formula | appearance | specification |
|---|---|---|---|
| boron phosphide | BP | fine brown powder | as synthesized |
| boron carbide | $B_4C$ | fine brown powder | <10 micron |
| potassium nitrate | $KNO_3$ | white powder | <15 micron |
| potassium chlorate | $KClO_3$ | fine white granular solid | MIL-P-150D, grade A, class 2 |
| potassium perchlorate | $KClO_4$ | white powder | MIL-P-217A, grade A, class 4 |
| sodium periodate | $NaIO_4$ | white powder | −325 mesh |
| sodium persulfate | $Na_2S_2O_8$ | white granular solid | crystalline |

Table 5 is a summary of the combustion properties of the boron phosphide with the oxidizer indicated.

TABLE 5

Summary of Combustion Properties. [a)]

| system | component ratio | burning time (s) | effect |
|---|---|---|---|
| $BP/KNO_3$ | 50/50 | 1.0 | green flame, white smoke |
| $BP/KClO_3$ | 50/50 | 0.2 | green flash, white smoke |
| $BP/KClO_4$ | 50/50 | 0.2 [b)] | green flash, white smoke |
| $BP/NaIO_4$ | 50/50 | 0.3 | yellow-green flash, purple-tinged smoke |
| $BP/Na_2S_2O_8$ | 50/50 | 0.9 | yellow-green flame, white smoke, rotten egg odor |
| $B_4C/KNO_3$ | 15/85 | 11.9 [c)] | intermittent smoldering, white smoke |

[a)] Test conditions were 58° F. and 43% relative humidity.
[b)] Some residual material continued to burn for another 0.1 seconds.
[c)] Incomplete combustion.

Table 6 is the combustion efficiencies for the tested compositions.

TABLE 6

Combustion Efficiencies.

| system | component ratio | sample size (g) | residue (g) | percentage residue (%) |
|---|---|---|---|---|
| $BP/KNO_3$ | 50/50 | 0.50 | 0.15 | 30 |
| $BP/KClO_3$ | 50/50 | 0.50 | 0.20 | 40 |
| $BP/KClO_4$ | 50/50 | 0.50 | 0.14 | 28 |
| $BP/NaIO_4$ | 50/50 | 0.50 | 0.22 | 44 |
| $BP/Na_2S_2O_8$ | 50/50 | 0.50 | 0.31 | 62 |
| $B_4C/KNO_3$ | 15/85 | 0.50 | 0.39 [a)] | 78 [a)] |

[a)] Much of the remaining material had not reacted.

The thickness of the smoke cloud produced by the $BP/KNO_3$ composition is thought to be caused by the occurrence of the reaction $8BP+3KNO_3 \rightarrow 3KBO_2+4P_2+B_2O_3+3BN$. The elemental phosphorus that is produced in situ, as $P_2$ in the gas phase, undergoes secondary combustion with oxygen in the atmosphere, forming hygroscopic phosphorus oxides. These oxides rapidly absorb atmospheric moisture and cause the resulting smoke cloud to be more massive and opaque than it would be otherwise.

Figure 5:
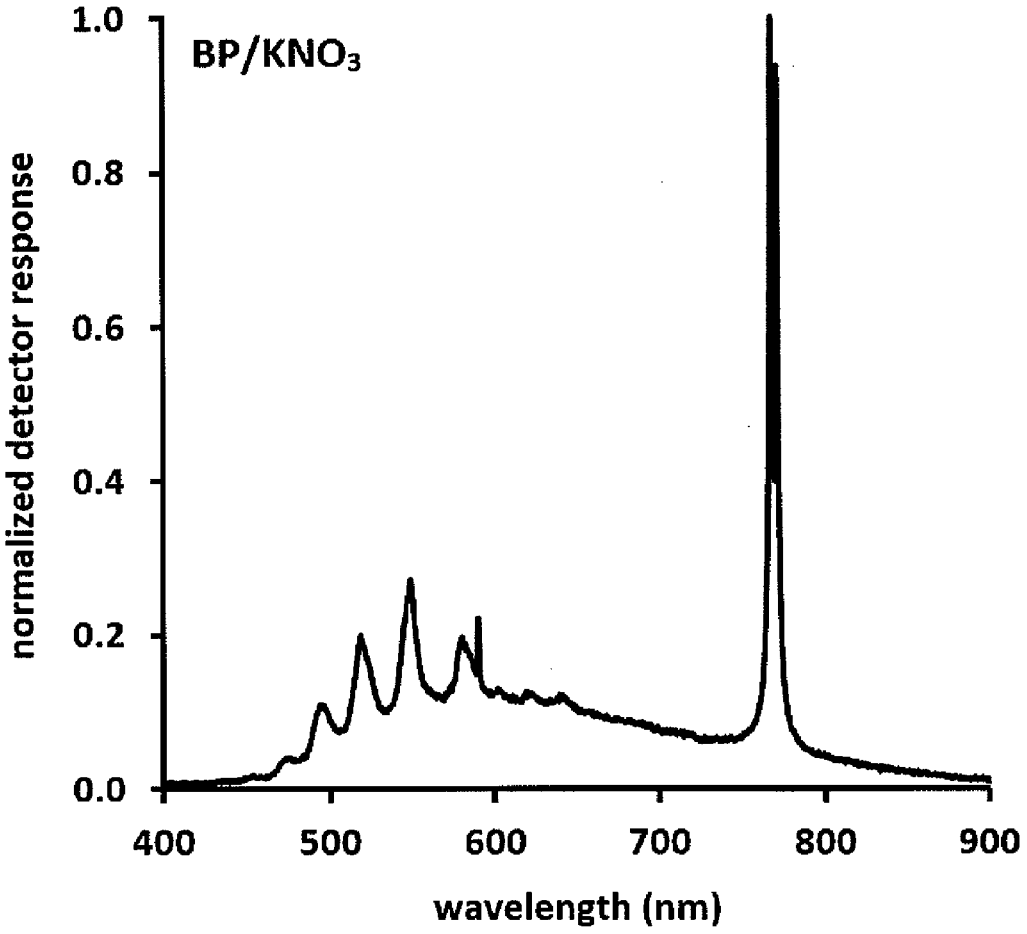
FIG. 5. is a visible spectrum plot produced upon combustion of the BP/$KNO_3$ composition.
Figure 6:
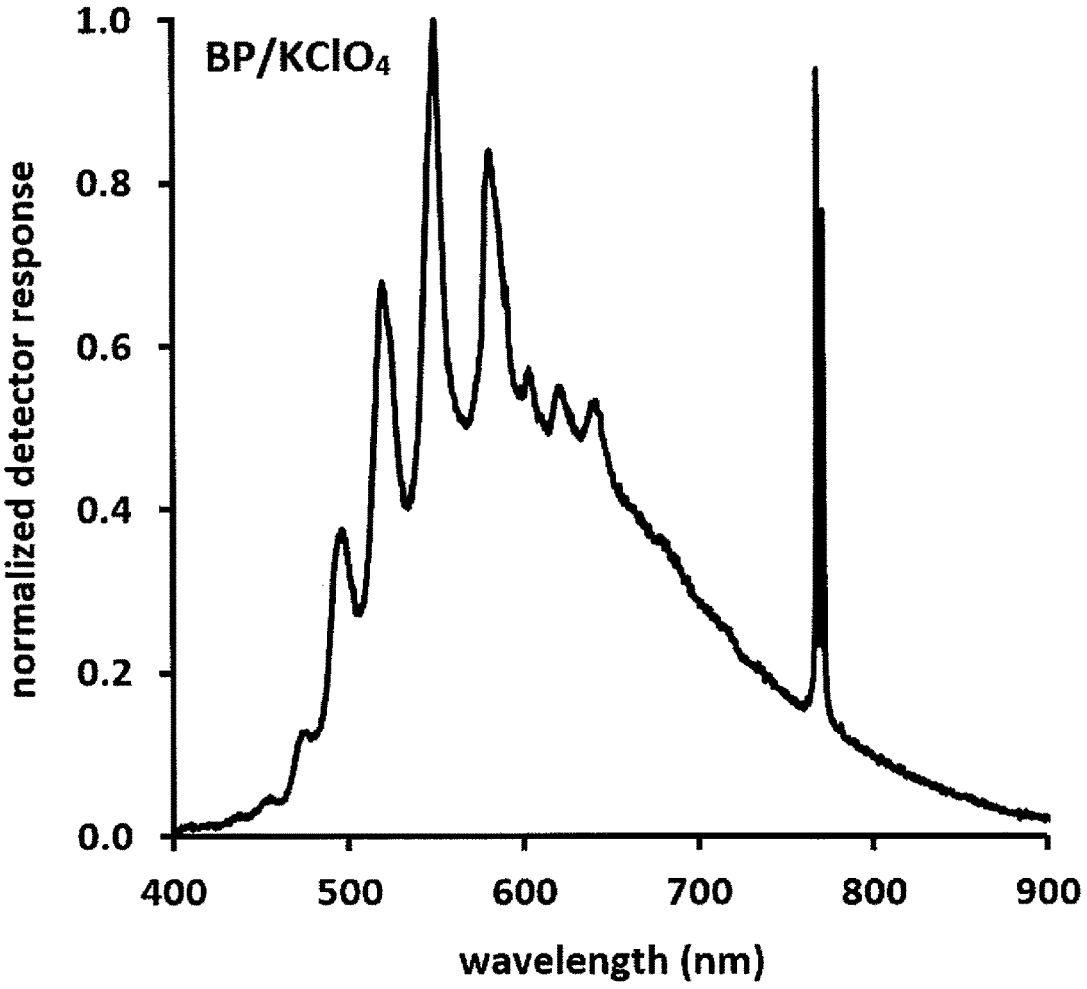
FIG. 6. is a visible spectrum plot produced upon combustion of the BP/$KClO_4$ composition.
Figure 7:
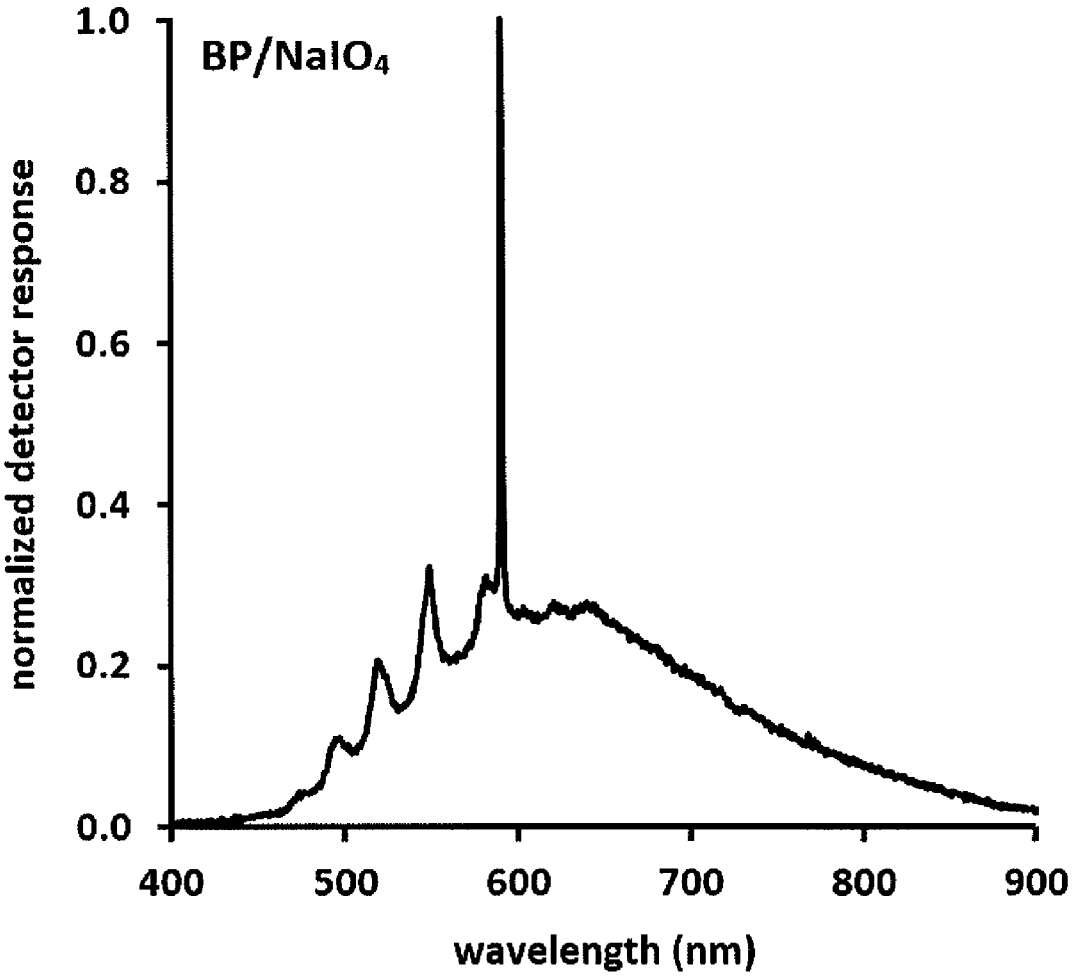
FIG. 7. is a visible spectrum plot produced upon combustion of the BP/$NaIO_4$ composition.

Modification to the color and characteristics of the BP and oxidizer pyrotechnic combustion events can be obtained by the following: 1) Using $NaIO_4$ to tinge the smoke purple through the presence of elemental iodine. 2) The compositions produce a yellow-green or a green flame or flash upon combustion. The color of the light is made more yellow by the presence of sodium in the oxidizer, whereas the potassium-based oxidizers produce a vivid green color. 3) The green color of the flames and flashes arises from transient $BO_2$ radicals in the plume, whereas the yellow element is caused by the presence of transient atomic sodium. For example, in FIG. 5, combustion of the $BP/KNO_3$ composition produced $BO_2$ as illustrated by the broad $BO_2$ lines from about 480-580 nm. The $BO_2$ may be responsible for the green color that is observed. The potassium emission lines above 700 nm, approaching the near-IR region, do not significantly influence the visible effect. In FIG. 6, combustion of the $BP/KClO_4$ composition produces a related spectral plot. In this instance, the $BO_2$ emission lines are remarkably intense in comparison to the potassium emission lines above 700 nm. A similar spectral response is produced by the $BP/KClO_3$ composition. In FIG. 7, combustion of the $BP/NaIO_4$ composition is similar to the combustion of the $BP/Na_2S_2O_8$ composition. In these instances, the presence of the sodium emission lines at about 589 nm causes the light emitted to appear as a yellow-green color. 4) Odorous sulfur compounds can be dispersed by the use of $Na_2S_2O_8$ as the oxidizer. 5) Using halogen oxidizers such as $KClO_3$, $KClO_4$, or $NaIO_4$ causes a violent reaction and results in an intense flash of light. The use of $KNO_3$ or $Na_2S_2O_8$ causes the production of a flame, as the reactions are not as rapid. The reaction rate which controls the duration of each system may be adjusted further by changing the particle size of the fuel or oxidizer or the ratio of the two, or the consolidated density of the composition, or the test configuration.

The pyrotechnic reactivity of the BP/oxidizer compositions is strikingly intense in comparison to $B_4C/KNO_3$. Additionally, the BP/oxidizer compositions leave a moderate amount of residue upon combustion, indicating the formation of a substantial quantity of gases during the combustion events.

The foregoing description of the embodiments of the present invention has been presented for the purpose of illustration and description. It is not intended to be exhaustive or to limit the invention to the precise form disclosed.

Many modifications and variations are possible in light of the above teachings. It is intended that the scope of the present invention not be limited by this detailed description but by the claims and any equivalents.

What is claimed is:

1. A mixture comprising crystalline boron phosphide wherein the specific surface area of the crystalline boron phosphide is between 0.05 $m^2/g$ and 40 $m^2/g$ and a solid oxidizer, wherein said mixture is a solid pyrotechnic composition.

2. The mixture of claim 1, wherein the oxidizer is selected from the group consisting of potassium nitrate, potassium chlorate, potassium perchlorate, sodium periodate, and sodium persulfate.

3. The mixture of claim 1, wherein the oxidizer is potassium nitrate.

4. The mixture of claim 1, wherein the specific surface area of the crystalline boron phosphide is between 0.5 $m^2/g$ and 20 $m^2/g$.

5. The mixture of claim 1, wherein the specific surface area of the crystalline boron phosphide is between 4 $m^2/g$ and 14 $m^2/g$.

6. The mixture of claim 1, wherein ignition of the pyrotechnic composition produces smoke and flame.

7. The mixture of claim 6, wherein the flame is green.

8. The mixture of claim 1, wherein the boron phosphide is prepared by a high-temperature synthesis reaction comprising:

a. mixing a composition consisting essentially of boron phosphate and magnesium metal into a homogenous mixture;

b. loading the homogenous mixture into a column structure;

c. packing the homogenous mixture at a pressure of 0 psi to 20,000 psi to form a pellet;

d. igniting the pellet by applying a minimum energy input to initiate a self-propagating high-temperature synthesis reaction of the pellet.

9. The mixture of claim 8, wherein the minimum energy input is about 0.025% to about 20% of the heat output of the homogenous mixture.

10. The mixture of claim 8, wherein the homogenous mixture is packed at a pressure of up to about 10,000 psi.

11. The mixture of claim 8, wherein the homogenous mixture is packed into a powderous column or self-standing pellet form.

12. The mixture of claim 8, wherein the homogenous mixture is packed into the column without any pressure.

13. The mixture of claim 8, wherein the mass ratio of the magnesium and boron phosphate is about 1:1.

14. The mixture of claim 8, wherein the particle size of the magnesium metal is less than 74 microns.

15. A mixture comprising crystalline boron phosphide wherein the specific surface area of the crystalline boron phosphide is between 0.05 $m^2/g$ and 40 $m^2/g$ and potassium nitrate, wherein the crystalline boron phosphide is prepared by a self-propagating high-temperature synthesis reaction and wherein ignition of the composition produces smoke and flame.

* * * * *